United States Patent [19]

Nadolph et al.

[11] Patent Number: 4,917,076

[45] Date of Patent: Apr. 17, 1990

[54] DEVICE FOR KEEPING WARM OR COOLING FOODS OR BEVERAGES

[76] Inventors: Bruno Nadolph; Rene Bucking, both of Haus 79, A-9581 Ledenitzen (Karnten), Austria

[21] Appl. No.: 206,349

[22] Filed: Jun. 14, 1988

[51] Int. Cl.[4] ..... A47J 36/24

[52] U.S. Cl. ..... 126/375; 126/246; 126/400; 220/69

[58] Field of Search ..... 220/69; 126/246, 375, 126/39 F, 273.5

[56] References Cited

U.S. PATENT DOCUMENTS

| | | | |
|---|---|---|---|
| 1,049,385 | 1/1913 | Mohrenwitz | 126/375 |
| 2,830,576 | 4/1958 | Torino et al. . | |
| 3,054,395 | 9/1962 | Torino | 126/375 |
| 3,065,744 | 11/1962 | Scavullo | 126/375 |
| 3,916,872 | 11/1975 | Kreis | 126/375 |
| 3,970,068 | 7/1976 | Sato . | |
| 4,086,907 | 5/1978 | Rothschild . | |

FOREIGN PATENT DOCUMENTS

| | | |
|---|---|---|
| 331442 | 8/1976 | Austria . |
| 232632 | 11/1909 | Fed. Rep. of Germany . |
| 294554 | 9/1915 | Fed. Rep. of Germany . |
| 3523916 | 1/1987 | Fed. Rep. of Germany . |
| 374812 | 3/1964 | Switzerland . |
| 459500 | 9/1968 | Switzerland . |
| 180056 | 5/1922 | United Kingdom . |

*Primary Examiner*—Stephen Marcus

*Attorney, Agent, or Firm*—Young & Thompson

[57] ABSTRACT

A container (1) for foods and/or beverages is proposed, a body (5) of heat-storing material being attached thereto in contact with the underside thereof. The body (5) is releasably connected to the container (1), for example by way of magnets, and either supplies heat to the container (1) or withdraws heat from the container (1). The outer surfaces of the body (5) are covered by a removable lining (3) of insulating material.

3 Claims, 2 Drawing Sheets

DEVICE FOR KEEPING WARM OR COOLING FOODS OR BEVERAGES

Figure 1:
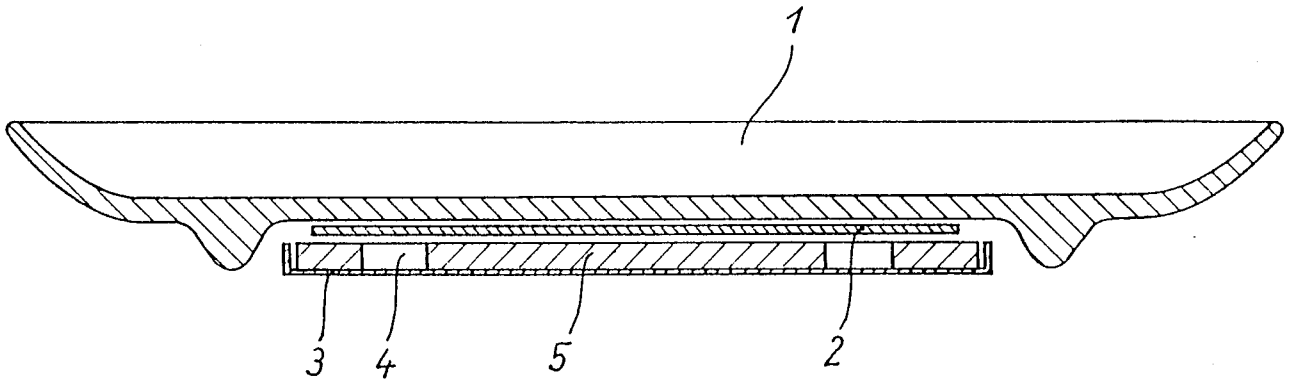

The invention relates to a device for keeping warm or cooling foods and/or beverages, with a container for holding the food or beverage, e.g. a plate or a cup, and with a body releasably connected to the container in contact therewith, this body consisting at least in part of a material having heat storage capability wherein the body joined to the container is fashioned as a disk and is held in contact with the underside of the container by means of magnetic forces. The magnets are inserted in the body, for example, in the center thereof or in the zone of the outer edge thereof.

It is known to preheat plates and like tableware before filling same with food or beverage so that it does not cool off too quickly during consumption. A drawback of these conventional measures resides in that the plates, after having been heated up, are so hot that they can be seized manually only with difficulties, and the serving personnel or the guest can burn their fingers on the container. Also, it is frequently not of advantage for the foods held by the tableware to come initially into contact with tableware that is too hot. Heretofore, it has been impossible to serve a correctly temperature-controlled plate maintaining the temperature over the entire time period of consumption of the meal.

It is furthermore known to utilize hot plates heated in special appliances, or to use hot plates that can be connected to an electrical outlet, on which dishes and the like, carrying foods to be served at table, can be placed to keep them warm. Also these hot plates present the danger of burning one's fingers and, moreover, the problem of keeping warm the plates from which the food is eaten has not been solved.

Therefore, various suggestions have been advanced for solving this problem.

U.S. Pat. No. A-3,970,068 concerns a food container wherein the food or beverage housed therein can be warmed or cooled. For heating or cooling purposes, an exothermic and, respectively, endothermic reaction is utilized; for this purpose, the container known from U.S. Pat. No. A-3,970,068 exhibits three chambers separated from one another, wherein the chambers housing the substances reacting with one another in endothermic or exothermic reaction are initially separated from one another and, if needed, can be placed in communication with one another. For example, a needle is provided which can be used to pierce a partition of the chamber wherein a liquid reactant is contained.

British Patent No. A-180,056 discloses a plate for keeping food warm wherein a dish-like part can be attached via resilient hooks to the underside of the plate, heated water being provided in the space between the plate and the dish-like part.

A similar arrangement is shown in DE-A-207,335 with the exception that the container for warm water disposed on the underside of the plate is attached to the plate by means of snap closures, rather than by means of spring hooks.

The device for heating and keeping plates, dishes, or the like warm as disclosed in DE-A-232,632 comprises a metal plate provided laterally and on its underside with an insulating jacket consisting of asbestos. This unit of metal plate and insulating jacket is pressed into an opening provided on the underside of the plate or dish. Any additional measures for retaining the metal plate and its asbestos insulation are not disclosed.

Swiss No. A-374,812 describes a base for plates or the like, on which plates or the like can be placed. A metal disk, for example aluminum, is housed in the base and is heated, transferring its heat to the plate. In this arrangement, the provision can also be made that a steel wool pad or an asbestos pad with metal spring inserts is arranged between the disk and the plate. Swiss No. A-374,812 does not disclose any measures for joining the part receiving the heated metal disk to the plate; rather, the heated metal plate in its holder is first to be placed on the table before the guest and only then is the plate placed thereover (see Swiss No. A-374,812, lines 56–59).

Austrian No. B-331,442 describes a plate which can be attached to the underside of a dish or the like by way of magnetic forces. Rings of metal are countersunk into this plate. The plate proper consists of an insulating material. This design has the disadvantage that, while heating the metal rings, the insulating member is likewise heated up so that it can no longer fulfill its actual function.

A base for tableware which can be affixed to the tableware by way of magnetic forces is known from DE-A-3,506,280. This base serves for preventing heat radiation from the tableware onto a base surface (table or the like), rather than serving for keeping warm or cooling foods or beverages in a container.

The invention is based on the object of avoiding the aforedescribed disadvantages and providing a container for foods or beverages wherein foods or beverages can be kept warm or cooled uniformly and without temperature peaks, as well as over a relatively long period of time.

According to the invention, this object has been attained in a device for keeping warm or cooling foods or beverages of the aforedescribed type by providing that the body of a material with heat storage capability adheres by way of at least one magnet to a foil of magnetically conductive material attached to the underside of the container; and that the body of a material with heat storage capability is associated, on its surface facing away from the container, with a removable cover of heat-insulating material.

In the device according to the invention, attachment is possible in a simple way; the body of material having heat storage capability (e.g. a ceramic material) need not by itself be seized by hand. Since the cover of heat-insulating material is removable, this cover can be removed from the body of material with heat storage capability during the warming up or cooling of this body, and the insulating cover, differently from Austrian No. B-331,442, for example, is not concomitantly heated or cooled during the warming up or cooling steps.

The invention offers the advantage that the body joined to the container can be warmed up or cooled and connected to the container immediately prior to use of the latter, so that the material to be kept warm or to be cooled (food or drink) remains warm or cool for use in the container over the required time period (time of consumption).

The problem in the conventional suggestions sometimes resides not only in the fact that the plates are possibly too hot when served (fingers get burned, the process of serving is uneconomical since only 2–3, rather than 4–5 plates can be carried) but also in that protein is burned into the porcelain. Thereby, the porcelain is soiled. In most cases, the plates are also too cold because correct temperature control of the plates is practically impossible to achieve during the serving process (using heretofore known warming up devices).

Even if a plate was carefully preheated so that one's fingers will not get burned, the time span from arranging the meal on the plate up to serving this plate simply is too long to provide still an acceptably correct temperature during eating. And if, in addition, the food will be served in the open air, a really warm meal cannot anymore be expected. In contrast thereto, in the system of this invention, no cumbersome manipulations need to be handled. On the contrary, the chef can place the plate, at normal temperature, in the direct vicinity of the cooking or serving station or stations, and the food can thus be made ready to serve and, accordingly, even time and distance to reach the customary warm-keeping cabinets and the like is likewise saved.

For example, it suffices to set the plate down at a site, e.g. previously marked, of an appliance for warming up or cooling of the heat-storing bodies, where the latter will automatically adhere to the plate. The serving personnel then takes the plate, and sets it down on a previously marked place where the insulating is attached, preferably automatically. Accordingly, there is no added work for the kitchen or the serving operation; on the contrary, a more economical technique evolves for the kitchen. The serving personnel needs no protection from carrying hot dishes, need not grapple with reheaters for the table, and there will be no complaints any longer about plates that are too cold. In most cases, under practical conditions, the dishes bearing the prepared meals will never be carried to the table immediately, anyway.

In the system according to this invention, the plates will reach the correct eating temperature precisely at this point in time.

The body to be joined to the container can be adapted in its configuration to the shape of the container with which it is to be connected. Normally, the body will have the shape of a disk attached from the bottom to the container. The attachment to the underside of the container also affords the advantage that the body of heat-storing material is received in the customary, downwardly open indentation of the container, for example a plate, and thus will not come into direct contact with the tablecloth, or the table surface.

In this way, the heat is transferred initially directly to the container from the body, and is then transmitted from the container to the material to be kept warm, i.e. indirectly, or in a reverse process when foods or beverages are kept cool.

The attachment, according to the invention, of the heat-storing or heat-absorbing body at the container permits rapid and simple mounting and, respectively, dismounting of the body to and from the container.

The body of heat-storing material, detached from the container, can be warmed up or cooled in any desired way. For example, heating can take place in a microwave appliance with the aid of an infrared source, a steam or hot water heater, or also on or in an ordinary oven or range. In principle, it is also possible to insert in the heat-storing body an electrical heating wire and directly heat same electrically. Finally, heating by a chemical process (i.e. exothermic reaction of at least two chemical compounds inside or outside of the body, e.g., chemical insert in the disk) is also possible. Analogously, cooling is also possible by an endothermic reaction. Cooling of the body having heat storage capability can also be performed in refrigerators or other cooling units.

Figure 2:
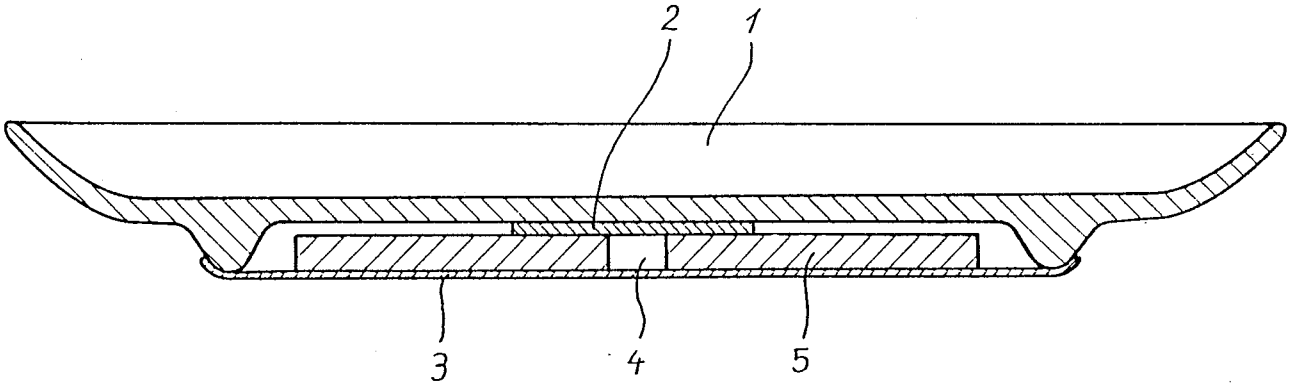

In the accompanying drawings,

FIG. 1 shows schematically and in a section view a first embodiment of the device according to the invention; and FIG. 2 shows a second embodiment thereof.

In the embodiment illustrated in FIG. 1, the container is fashioned as a plate 1. On the underside of plate 1, an adhesive disk 2 of magnetically conductive material is provided, fixedly connected to the plate, for example a steel or soft-iron foil made to be self-adhesive. Underneath the adhesive disk 2, a body 5 fashioned as a slab is provided, made up of a material having increased heat storage capability, e.g. ceramic. At least one magnet 4 (in the embodiment, two magnets) is inserted in the body 5. By way of such magnet, the body 5 can be joined to the plate 1 flatly in contact with the adhesive disk 2. The number of magnets 4 arranged in the body 5 is dependent on the size of body 5.

It can furthermore be seen from the drawing that the surfaces of the plate-shaped body 5 facing away from the plate 1 are provided with a removable, heat-insulating cover 3. The cover 3 ensures that the heat from body 5 passes primarily to the container 1 (plate) and is not radiated or conducted away downwards, i.e. unused (or, conversely, that no heat is absorbed from the surroundings).

Predominantly suitable materials for the slab 5 are ceramics, for example clay, but also metal. The insulation 3 consists, for example, of a heat-insulating synthetic resin.

It can be seen that, in the device of this invention, the body 5 can be slightly preheated (or cooled) and can then be simply joined to the plate 1. It can further be seen that the arrangement of body 5 according to the invention does not impede normal use of the plate 1 since the latter can be placed on a table as usual, and the body, if the rim of the container is adequately high, will not come into direct contact with the tablecloth or the table surface. Another advantage is derived from the feature that there is no need for energy supply at the table or for any special need for space at the usage site (table).

The device of this invention is suitable, in particular, for gourmet restaurant business in order to keep food warm during eating. The device disturbs neither the guest nor the serving personnel since it is located underneath the container, constituted by a plate 1, for example, and forms a unit with the latter during usage.

In order to clean the tableware, the body 5 can be readily detached again from the plate 1 and preheated for renewed usage.

When utilizing the device according to this invention, tableware need no longer be preheated so that there is no danger of receiving burns from excessively preheated china.

One advantage of the device according to this invention is also to be seen in that the heat transmitted by the body of heat-storing material becomes effective with a certain delay, due to the fact that a time period will go by before the heat passes through the bottom of the container, e.g. the plate 1, wherein the food is provided. In this way, the advantageous effect is achieved that heat is supplied to the food on the plate 1 only when it threatens to cool off. Accordingly, excess heating of the meal at the beginning is effectively precluded without taking expensive measures.

The body 5 can also be heated by means of an installed Peltier element. This brings the advantage that the body 5 is heated on one side and cooled simultaneously on the other side so that the body 5 can never become too hot on the underside facing the table. By turning over a body 5 equipped with a Peltier element and attaching the body to the container 1 in this way, the body serves for cooling purposes. The Peltier element can simply be connected to a correspondingly designed current supply.

In a modification of the embodiment shown in FIG. 1, the insulation 3 can also be larger and, as indicated in FIG. 2, can extend over the annular bead 6 arranged on the underside of the plate 1. FIG. 2 also shows an embodiment with only one magnet 4 in the body 5. In this case, the foil 2, as illustrated, can also be smaller.

The insulation 3 can be held at the body 5, for example, also by the magnetic forces exerted by the magnet 4; for this purpose, the insulation is provided on its inside, for example, with a coating of low-retentivity material, or carries a disk of low-retentivity material, arranged in the zone of the magnet or magnets 4.

What is claimed is:

1. Device for keeping warm or cooling foods or beverages, comprising a container (1) for holding the food or beverage, a body (5) releasably connected to the container (1) in contact therewith, this body comprising at least in part a material having heat storage capability and being in the form of a disk releasably held in contact with the underside of the container by means of magnetic forces, magnet means (4) in the body (5), a layer (2) of magnetically conductive material attached to the underside of the container (1), and a removable cover (3) of heat-insulating material on the surface of the body (5) facing away from the container (1), the container having a downwardly extending rim on which the container rests, said rim enclosing a cavity on the underside of the container in which said layer (2) and body (5) and cover (3) are disposed, the height of said rim being such that said body extends downward no farther than said rim.

2. Device according to claim 1, in which said layer (2) is a disk adhesively attached to the underside of the container (1).

3. Device according to claim 1, in which said cover (3) is of substantially lesser diameter than said rim, thereby to leave an annular gap between said cover and said rim.

* * * * *